US008300875B2

(12) United States Patent
Takebe et al.

(10) Patent No.: US 8,300,875 B2
(45) Date of Patent: Oct. 30, 2012

(54) SPEAKER DIAPHRAGM AND SPEAKER INCLUDING THE SAME

(75) Inventors: Toru Takebe, Tokyo (JP); Kunihiko Tokura, Tokyo (JP); Masaru Uryu, Chiba (JP); Takahisa Tagami, Kanagawa (JP); Emiko Ikeda, Tokyo (JP)

(73) Assignee: Sony Corporation, Tokyo (JP)

( * ) Notice: Subject to any disclaimer, the term of this patent is extended or adjusted under 35 U.S.C. 154(b) by 1013 days.

(21) Appl. No.: 12/070,610

(22) Filed: Feb. 20, 2008

(65) Prior Publication Data

US 2008/0199028 A1 Aug. 21, 2008

(30) Foreign Application Priority Data

Feb. 21, 2007 (JP) ..... 2007-041505

(51) Int. Cl.
*H04R 1/00* (2006.01)
*H04R 9/06* (2006.01)
*H04R 11/02* (2006.01)

(52) U.S. Cl. ..... 381/423; 381/398; 381/430

(58) Field of Classification Search ..... 381/423, 381/426, 184, 186, 398, 403–405, 422, 430, 381/417

See application file for complete search history.

(56) References Cited

U.S. PATENT DOCUMENTS 4,140,203 A * 2/1979 Niguchi et al. ..... 181/167
4,216,271 A * 8/1980 Takeuchi et al. ..... 428/607
5,259,036 A * 11/1993 Seeler ..... 381/426
5,329,072 A * 7/1994 Kageyama et al. ..... 181/167
2004/0112672 A1* 6/2004 Ono et al. ..... 181/169
2006/0222202 A1* 10/2006 Uryu et al. ..... 381/426
2009/0010471 A1* 1/2009 Okazaki et al. ..... 381/354

FOREIGN PATENT DOCUMENTS

| | | | |
|---|---|---|---|
| JP | 57-094297 | U | 6/1982 |
| JP | 58-188999 | A | 11/1983 |
| JP | 63-005795 | U | 1/1988 |
| JP | 01-074696 | U | 3/1989 |
| JP | 05-252588 | A | 9/1993 |
| JP | 11-099363 | A | 4/1999 |
| JP | 2000-202970 | A | 7/2000 |
| JP | 2002-374593 | A | 12/2002 |
| JP | 2003-348687 | A | 12/2003 |
| JP | 2004-004755 | A | 1/2004 |
| JP | 2006-295245 | A | 10/2006 |

OTHER PUBLICATIONS

Office Action for JP App. No. 2009-266481, Jul. 5, 2011.

* cited by examiner

*Primary Examiner* — Mohamad Musleh
*Assistant Examiner* — Mangtin Lian
(74) *Attorney, Agent, or Firm* — Wolf, Greenfield & Sacks, P.C.

(57) ABSTRACT

A speaker diaphragm includes a thermoplastic resin having a three-layer structure. The three-layer structure includes a polyester film as a base material of the three-layer structure, a polyimide-based resin layer as a top layer of the three-layer structure, and another polyimide-based resin layer as a bottom layer of the three-layer structure.

18 Claims, 10 Drawing Sheets

| COMPONENT | OPTIMUM THICKNESS ($\mu$m) |
|---|---|
| ENTIRE CONE | 50 |
| POLYETHYLENE TEREPHTHALATE (PET) LAYER | 38 |
| POLYIMIDE (PI) LAYERS | 6 (TOP) + 6 (BOTTOM) |

FIG. 4

| CHARACTERISTICS OF PI-COATED PET | | |
|---|---|---|
| DURING FORMING | FORMING TEMPERATURE | SAME AS PET |
| | PRODUCTION PROCESS | SAME AS PET |
| DURING OPERATION | INTERNAL LOSS | CLOSE TO THE CHARACTERISTIC OF PET (TO A NECESSARY EXTENT) |
| | FREQUENCY CHARACTERISTICS | SMOOTHER PEAK AND DIP THAN PET |
| DURING THERMAL DEFORMATION | SHAPE RETENTION ABILITY | RETAINS THE SHAPE FOR 100 HOURS AT A CONSTANT TEMPERATURE |
| | HEAT RESISTANCE | CHARACTERISTIC THAT SUPPRESSES THE EXTENT OF SOFTENING AFTER SOFTENING |

| COMPONENT | OPTIMUM THICKNESS ($\mu$m) |
|---|---|
| ENTIRE CONE | 50 |
| POLYBUTYLENE TEREPHTHALATE (PBT) LAYER | 38 |
| POLYETHERIMIDE (PEI) LAYERS | 6 (TOP) + 6 (BOTTOM) |

SPEAKER DIAPHRAGM AND SPEAKER INCLUDING THE SAME

CROSS REFERENCES TO RELATED APPLICATIONS

The present invention contains subject matter related to Japanese Patent Application JP 2007-041505 filed in the Japanese Patent Office on Feb. 21, 2007, the entire contents of which are incorporated herein by reference.

BACKGROUND OF THE INVENTION

1. Field of the Invention

The present invention relates to a diaphragm for speakers (hereinafter simply referred to as "speaker diaphragm") and a speaker including the speaker diaphragm.

2. Description of the Related Art

A speaker diaphragm for tweeters designed to reproduce a higher range of frequencies is in some cases made from an acoustic diaphragm material having a high elastic modulus so as to improve the frequency characteristic (first design approach). With this acoustic diaphragm material having a high elastic modulus, the frequency at which divided vibration occurs (hereinafter referred to as "divided vibration frequency") can be shifted to a higher range.

According to the first approach, ceramic materials such as silicon carbide (SiC), carbon graphite, and titanium oxide are used as the acoustic diaphragm material for the speaker diaphragm. Metal materials such as aluminum and titanium are also used.

Another design approach (second design approach) for making the divided vibration frequency higher is to improve the shape and structure of the speaker diaphragm. According to this approach, an elastic modulus substantially as high as that obtained by the first approach can be achieved by improving the shape and the structure of the speaker diaphragm even when an acoustic diaphragm material having a relatively low elastic modulus is used. These approaches have been employed to make the divided vibration frequency higher.

There is also suggested a technique of forming a speaker diaphragm by using a polyimide foam. According to this technique, a polyimide foam, which is a molded block having a predetermined thickness, is compressed under heating using a die (refer to Japanese Unexamined Patent Application Publication No. 2002-374593). As a result, a speaker diaphragm which is light-weight (low density) and has superior environmental resistance, high internal loss (tan δ), high formability, and high shape design flexibility can be obtained. Since the internal loss is high, the divided vibration does not easily occur.

SUMMARY OF THE INVENTION

The internal loss, which is one of the operation characteristics of the speaker diaphragm, will now be discussed. The internal loss is a value indicating the degree of absorbing the energy of sound. A speaker diaphragm composed of a ceramic material or a metal material has a very low internal loss, i.e., 0.01 or less.

Thus, the sound pressure characteristic in a frequency range in which the divided vibration occurs has sharp peaks and dips because of the divided vibration. Moreover, there is also a problem that the levels of peaks and dips that occur are high.

Occurrence of peaks and dips can be suppressed by using a material having a relatively high internal loss. In addition to using the material having a relatively high internal loss, the shape of the speaker diaphragm is improved so that the acoustic signals can be reproduced up to a higher range.

According to this technique, in order to achieve the desired acoustic performance, it is important that the diaphragm material be formed into a predetermined shape and that the shape be retained. A polymeric material is frequently used as the material having a relatively high internal loss. However, formability is in conflict with heat resistance in polymeric materials, in particular, thermoplastic materials, which is problem.

One of the unique characteristics of thermoplastic materials is the presence of the glass transition point. The glass transition point is a value indicating the boundary point of the temperature at which the material softens or hardens. A material softens and enters a liquid state at a temperature exceeding the glass transition point.

One conceivable approach is to use a material having a relatively low glass transition point, such as polyethylene terephthalate (PET), as the speaker diaphragm material. Satisfactory acoustic characteristics can be achieved with PET during initial operation. However, long time operation allows the heat generated from the bobbin coil to reach PET, and the PET speaker diaphragm may no longer retain the original shape or achieve the designed acoustic characteristics. Thus, the maximum power input is limited.

Another conceivable approach is to use a material having a relatively high glass transition point. For example, polyimide may be used. In such a case, the forming temperature is increased to the glass transition point or higher. Since this involves a longer heating and cooling time during forming, the productivity will be degraded. As a result, the cost of the diaphragm will increase. Furthermore, polyimide films are more expensive than PET films or the like. Polyimide films have a lower internal loss than the PET materials and exhibit characteristics close to those of metal materials. As a result, the problem of occurrence of peaks and dips arises.

Moreover, in the case where polyimide alone is used as the material for the speaker diaphragm as in the technology disclosed in the aforementioned document, Japanese Unexamined Patent Application Publication No. 2002-374593, the forming temperature is high, i.e., 300° C.; therefore, the production process becomes complicated. Also, since the internal loss is low, the desired operation characteristics may not be achieved. It is also difficult to form a homogeneous polyimide foam.

It is desirable to provide a speaker diaphragm composed of a thermoplastic material, in which a good balance between formability and heat resistance, the desired internal loss, and a smooth frequency characteristic are achieved.

There is provided a speaker diaphragm including a thermoplastic resin having a three-layer structure. The three-layer structure includes a polyester film as a base material of the three-layer structure, a polyimide-based resin layer as a top layer of the three-layer structure, and another polyimide-based resin layer as a bottom layer of the three-layer structure.

Since the polyester film having good formability coated with polyimide having good heat resistance is used, the frequency characteristic can be smoothed while improving the heat resistance.

The thicknesses of the base material, the top layer, and the bottom layer of the three-layer structure may be set according to a production process or a forming temperature during forming of the speaker diaphragm or an internal loss or a frequency characteristic during operation of the speaker diaphragm. The thicknesses may be set according to the elastic modulus of the speaker diaphragm during temperature elevation.

The polyimide-based resin used in the top and bottom layers of the three-layer structure may be polyimide or polyetherimide. The polyester film may be composed of polyethylene terephthalate or polybutylene terephthalate.

Experiments show that the optimum thicknesses of the base material (polyester film), the top layer (polyimide-based resin film), and the bottom layer (polyimide-based resin film) of the three-layer structure are 38 mm, 6 μm, and 6 μm, respectively where the total thickness of the three-layer structure is 50 μm.

A speaker incorporates the speaker diaphragm including the three-layer structure including the polyester film as the base material and the polyimide-based resin layers as the top and bottom layers. Since the heat resistance can be improved with this structure, the maximum power input is enhanced while improving formability.

Accordingly, the speaker diaphragm retains its shape during temperature elevation. The internal loss desired during the operation of the speaker diaphragm can be achieved, and the frequency characteristic can be made smooth.

BRIEF DESCRIPTION OF THE DRAWINGS

FIG. 4 is a table showing the characteristics of polyethylene terephthalate (PET) coated with polyimide (PI);

DESCRIPTION OF THE PREFERRED EMBODIMENTS

Embodiments will now be described in detail with reference to FIGS. 1 to 12.

Figure 1:
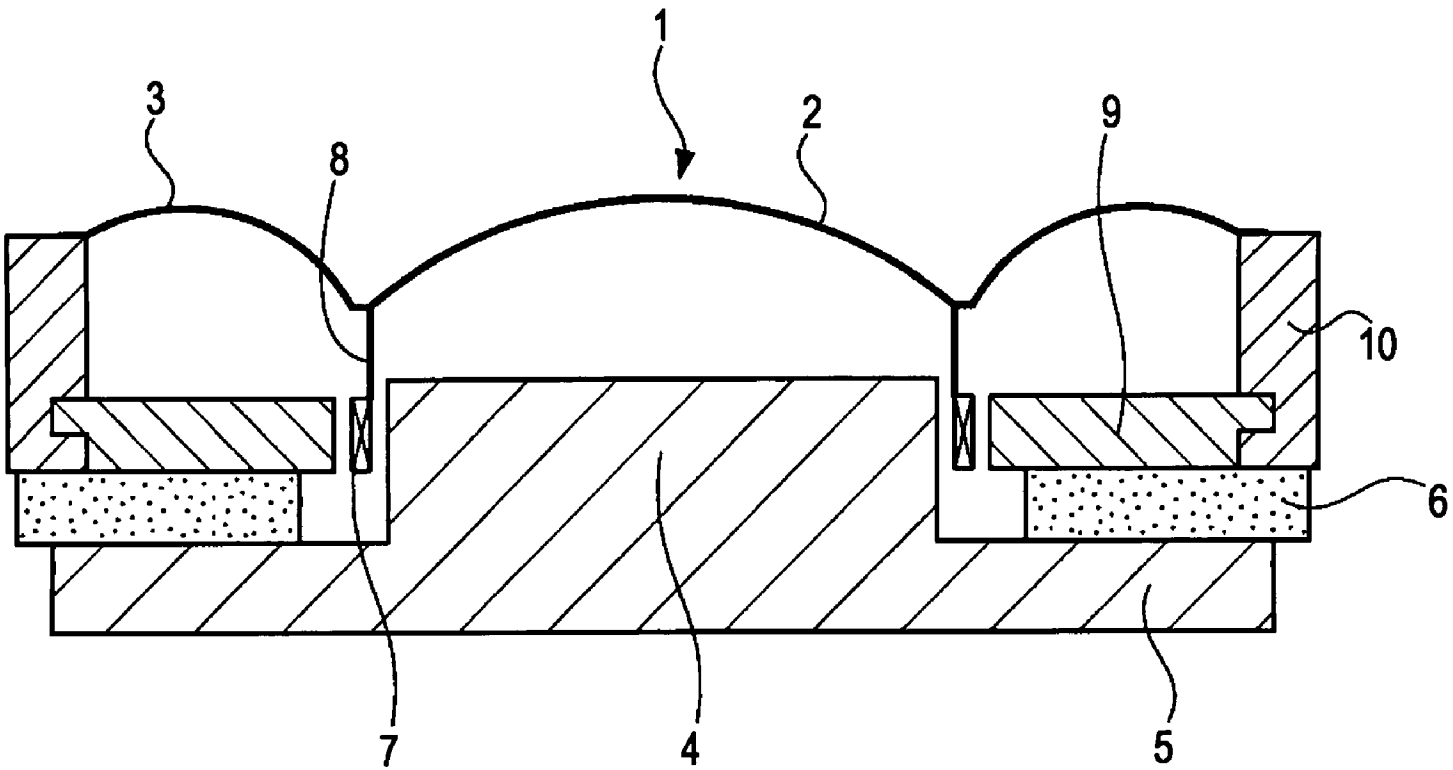
FIG. 1 is a diagram for explaining a speaker vibration section of a speaker according to an embodiment.

FIG. 1 is a diagram for explaining a speaker vibration section of a speaker. The speaker vibration section shown in FIG. 1 is part of a speaker unit.

Referring to FIG. 1, a cone, which functions as a speaker diaphragm 1, is desirably thin so that the cone can move easily, and is desirably light-weight and durable. Moreover, the cone desirably gives an adequate degree of loss, i.e., internal loss, to reduce the peaks and dips in the frequency characteristic and the transient characteristics.

The internal loss indicates the degree at which the energy of sound output from the speaker diaphragm 1 is absorbed. The speaker diaphragm 1 desirably has a particular level of internal loss as the operation characteristic.

The speaker includes a magnetic circuit that includes a ring-shaped magnet 6, a first magnetic yoke and a second magnetic yoke both composed of a magnetic material such as iron, and a magnetic gap. The first magnetic yoke includes a cylindrical center pole 4 and a disk-shaped flange 5 orthogonal to the cylindrical center pole 4.

The second magnetic yoke is a plate 9. The plate 9 has a shape of a ring having an inner diameter larger than the outer diameter of the cylindrical center pole 4 by a length corresponding to the magnetic gap. The cylindrical center pole 4 is inserted into the inner void of the ring-shaped magnet 6 and inner void of the plate 9.

In this state, the magnet 6 is sandwiched between the upper surface of the flange 5 and the lower surface of the plate 9. The magnet 6 is bonded to the upper surface of the flange 5 and the lower surface of the plate 9 with an adhesive.

The speaker diaphragm 1 includes a dome portion 2 and an edge portion 3. The dome portion 2 is located in the central portion and has a cross-section substantially arcuate in shape. The edge portion 3 is located at the outer-periphery-side of the edge portion 3 with a connecting portion between the edge portion 3 and the dome portion 2. The dome portion 2 and the edge portion 3 are formed as an integral member.

The upper edge of a cylindrical voice coil bobbin 8 composed of a nonconductor is fixed with an adhesive to the inner peripheral portion of the dome portion 2 of the speaker diaphragm 1. A voice coil 7 wound at a particular position of the voice coil bobbin 8 is disposed in the magnetic gap between the plate 9 and the center pole 4. The outer periphery portion of the edge portion 3 of the speaker diaphragm 1 is fixed with an adhesive to a speaker frame 10.

In the speaker shown in FIG. 1, electrical current flows in the voice coil 7 when an acoustic signal is fed to the voice coil 7. The electromagnetic induction between the current flowing in the voice coil 7 and the magnetic flux in the magnetic gap vibrates the speaker diaphragm 1 through which sound is output.

Figures 2, 3:
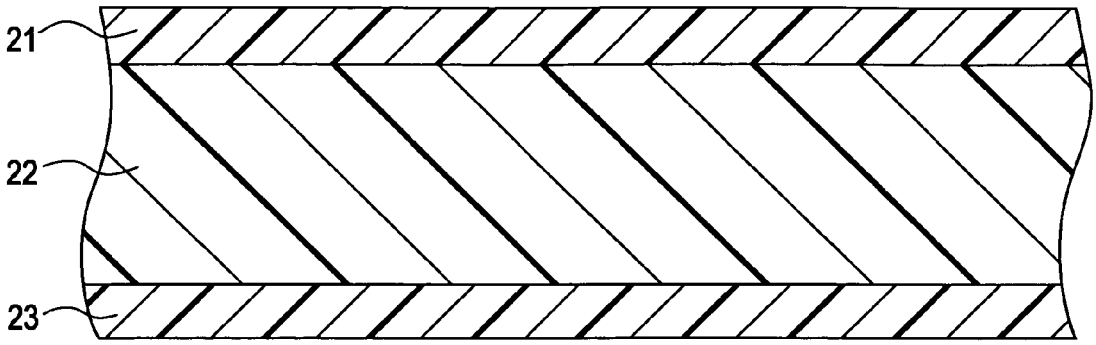
FIG. 2 is a cross-sectional view of a speaker diaphragm.
FIG. 3 is a table showing the optimum thickness of a cone, i.e., the speaker diaphragm.

FIG. 2 is a partial enlarged cross-sectional view of the cone, i.e., the speaker diaphragm 1, shown in FIG. 1.

In FIG. 2, the speaker diaphragm is a resin speaker diaphragm composed of a thermoplastic polymer material and having a three-layer structure. In particular, a polyester film, i.e., a polyethylene terephthalate (PET) layer 22, is used as the base material of the three-layer structure.

A polyimide (PI) layer 21 and a polyimide (PI) layer 23 are respectively disposed as the top layer and the bottom layer of the three-layer structure. In other words, both sides of the polyethylene terephthalate (PET) layer 22 are provided with thin-film coatings, i.e., the polyimide (PI) layers 21 and 23, respectively.

A polyester film, i.e., the terephthalate (PET) layer 22, is used as the base material because the formability of the polyethylene terephthalate during production process is excellent. The polyimide (PI) layers 21 and 23 are used as the coating films for the top layer and the bottom layer because the heat resistance of the polyimide (PI) during temperature elevation is excellent.

As discussed above, a material including the polyethylene terephthalate (PET) layer 22 and the polyimide (PI) layers 21 and 23 coating the polyethylene terephthalate (PET) layer 22 is used as the speaker diaphragm. Thus, the internal loss close to the internal loss of polyethylene terephthalate is achieved while improving the heat resistance. Moreover, the frequency characteristic can be made smooth.

The thicknesses of the base layer, the top layer, and the bottom layer of the three-layer structure are set so that the production process of forming the speaker diaphragm having the three-layer structure is the same as the production process of forming a speaker diaphragm constituted from a polyester film only.

Moreover, the thicknesses of the base layer, the top layer, and the bottom layer of the three-layer structure are set so that the forming temperature during forming of the speaker diaphragm having the three-layer structure is the same as the forming temperature of a speaker diaphragm constituted from a polyester film only.

The thicknesses of the base layer, the top layer, and the bottom layer of the three-layer structure are set so that the internal loss during operation of the speaker diaphragm having the three-layer structure is close to that of a speaker diaphragm constituted from a polyester film only.

The thicknesses of the base layer, the top layer, and the bottom layer of the three-layer structure are set so that the frequency characteristic during operation of the speaker diaphragm having the three-layer structure has smaller peaks and dips than the frequency characteristic of a speaker diaphragm constituted from a polyester film only.

The thicknesses of the base layer, the top layer, and the bottom layer of the three-layer structure are set so that the speaker diaphragm relatively maintains the elastic modulus during the temperature elevation even in a temperature range where an elastic modulus of a speaker diaphragm constituted from a polyester single film decreases.

The coating films used for the top layer and the bottom layer of the three-layer structure may be any polyimide-based resin films. For example, polyimide (PI) or polyetherimide (PEI) films are used as the coating films. A polyethylene terephthalate (PET) or polybutylene terephthalate (PBT) film may be used as the polyester film.

The embodiment will now be described by using specific experimental results.

A speaker was assembled to have a structure shown in FIG. 1.

The speaker diaphragm was formed to have a predetermined shape. Examples of the forming process include press forming and pneumatic forming. In any forming process, a die heated to a forming temperature was used and the material was slowly cooled while retaining the shape. As a result, a speaker diaphragm of a desired shape was obtained. The shape of the speaker diaphragm is in compliance with the specifications previously provided.

FIG. 3 is a table showing the optimum thicknesses of a cone of the speaker diaphragm.

FIG. 3 shows experimentally identified values of optimum thicknesses of the three-layer structure including a polyethylene terephthalate (PET) layer as the base material and polyimide (PI) layers as the top and bottom layers of the three-layer structure.

The optimum total thickness of the cone having the three-layer structure was 50 μm. The optimum thickness of the polyethylene terephthalate (PET) layer as the base material of the three-layer structure was 38 μm. The optimum thickness of each of the polyimide (PI) layers as the top and bottom layers of the three-layer structure was 6 μm.

The characteristics of the speaker diaphragm having the above-described optimum thicknesses will now be described.

FIG. 4 is a table showing the characteristics of polyethylene terephthalate (PET) coated with polyimide (PI).

The characteristics of the PI-coated PET shown in FIG. 4 are as follows: characteristics during forming, characteristics during operation, and characteristics during thermal deformation.

The characteristics during forming include a forming temperature and a production process. The forming temperature is the same as in the case involving uncoated polyethylene terephthalate. The production process is also the same as in the case involving uncoated polyethylene terephthalate.

The characteristics during operation include internal loss and frequency characteristic. The internal loss of the PI-coated PET is close to that of uncoated polyethylene terephthalate. The meaning of the phrase "internal loss is close to" is that a sufficient level of internal loss is achieved. The frequency characteristic of the PI-coated PET has smaller peaks and dips than the case involving uncoated polyethylene terephthalate.

The characteristics during thermal deformation include shape retention ability and heat resistance. The shape retention ability is the ability of the material of retaining the shape at a particular temperature for 100 hours. The heat resistance is the property showing suppression of the extent of softening after softening.

Figure 5:
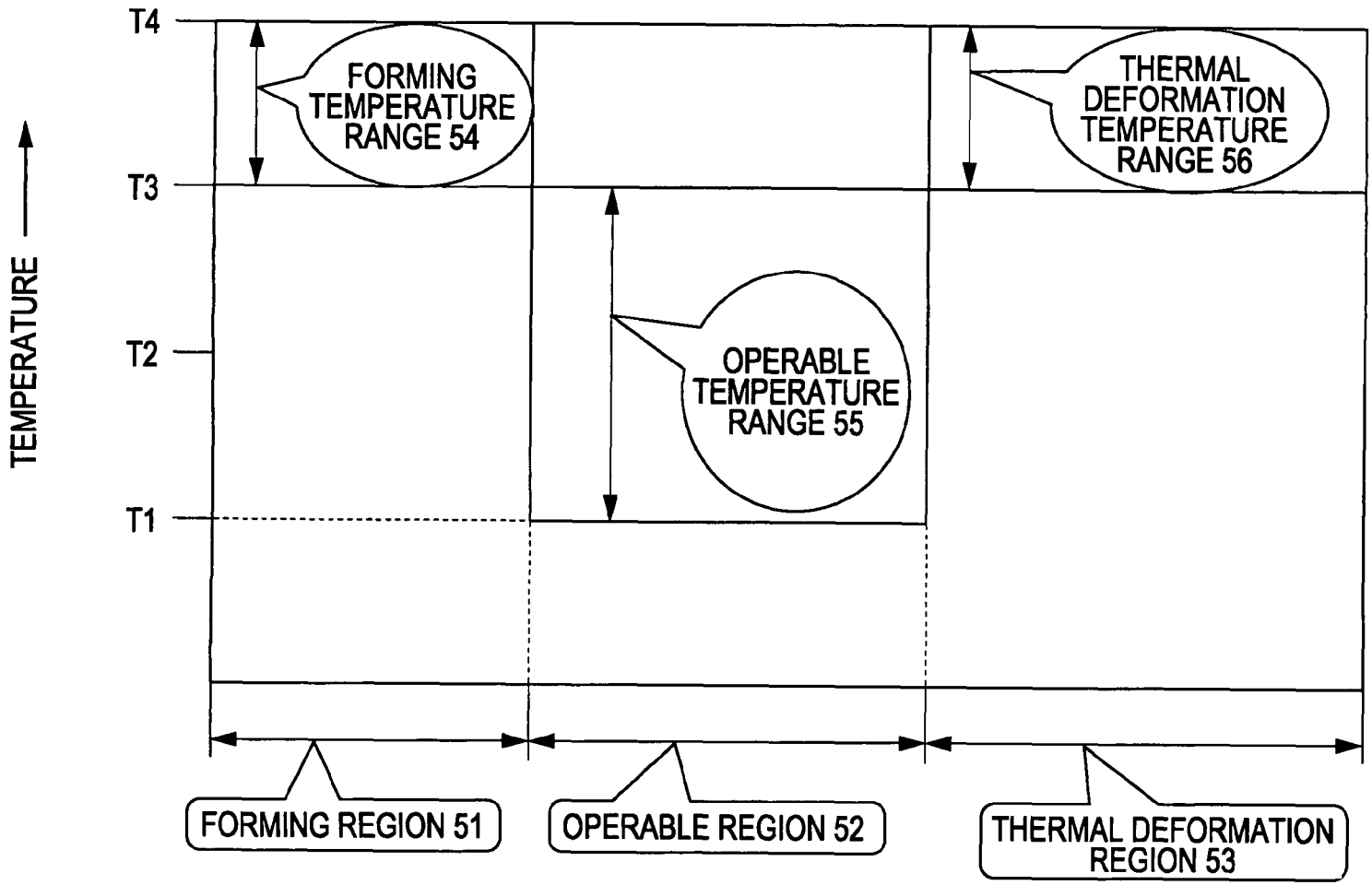
FIG. 5 is a diagram showing a forming temperature, an operable temperature, and a thermal deformation temperature.

FIG. 5 is a diagram showing the forming temperature, operable temperature, and thermal deformation temperature.

As shown in FIG. 5, a forming region 51 involves a forming temperature range 54 covering from the glass transition point, i.e., T3, to a relatively high temperature T4 (inclusive). The forming temperature range 54 is the temperature range in which the forming can be easily carried out. Accordingly, the component and the thickness are desirably selected to withstand the temperature in the forming temperature range 54.

An operable region 52 involves an operable temperature range 55 covering from a relatively low temperature T1 to the glass transition point T3 (inclusive). The operable temperature range 55 is the temperature range in which the desired operation characteristics can be achieved. Accordingly, the component and the thickness are desirably selected to withstand the temperature in the operable temperature range 55.

A thermal deformation region 53 involves a thermal deformation temperature range 56 covering from the glass transition point T3 to the relatively high temperature T4 (inclusive). The thermal deformation temperature range 56 is the temperature range in which the shape can be retained and heat resistance can be exhibited during temperature elevation. Thus, the component and the thickness are desirably selected to withstand the temperature in the thermal deformation temperature range 56.

The operation characteristics were evaluated by using two film components as the materials for the speaker diaphragms. The first film component (50 μm thick) was a PET single layer film, which is referred to as "PET film" hereinafter.

The second film component (50 μm thick) was a polyethylene terephthalate film coated with polyimide, which is referred to as "PI-coated PET film" hereinafter.

The relationships between the internal loss and the frequency for the PET film and the PI-coated PET film are compared as below.

Figure 6:
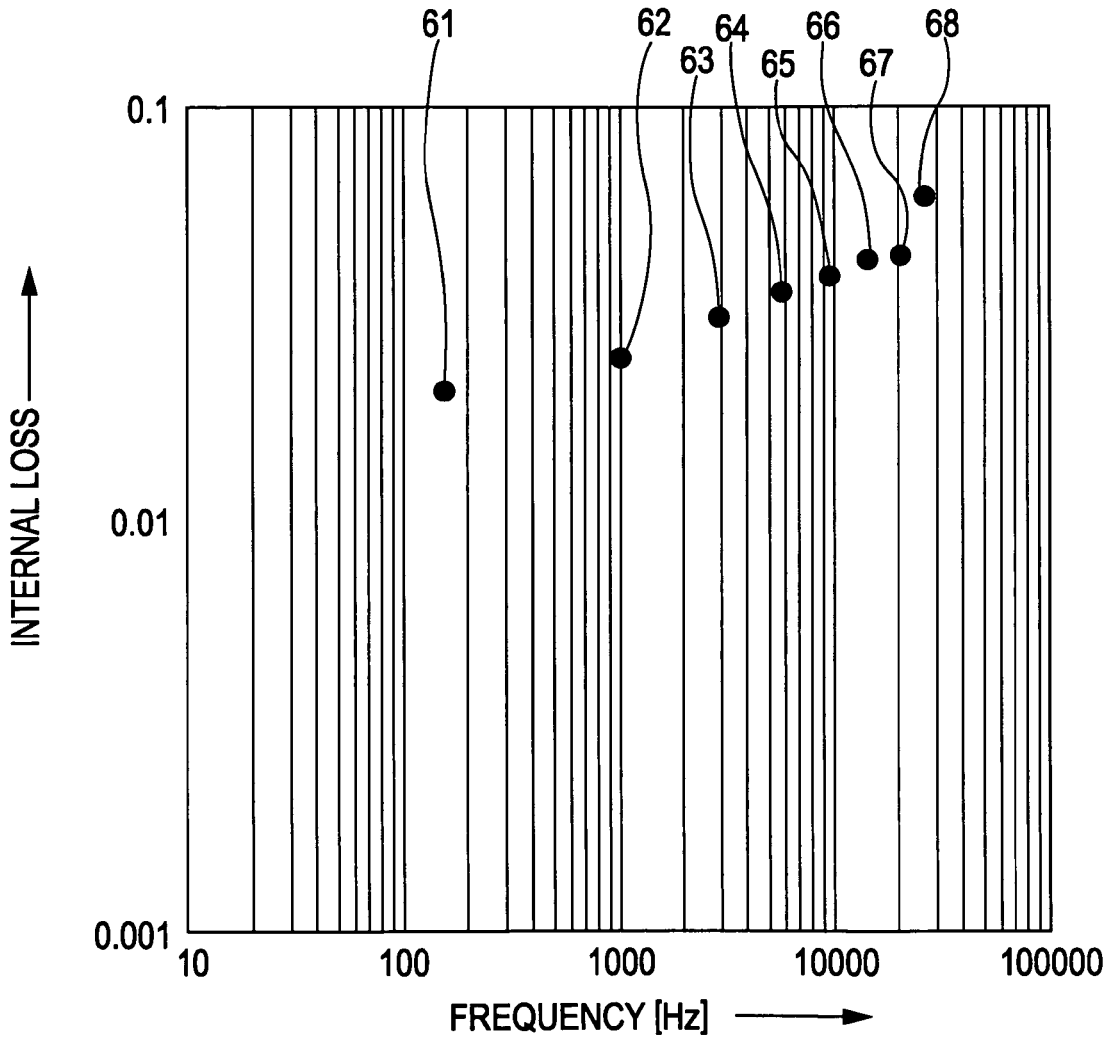
FIG. 6 is a graph showing the relationship between the internal loss of a PET film and the frequency.

The relationship between the internal loss and the frequency for the PET film is shown in FIG. 6. In the drawing, the internal loss is indicated as a relative value.

In FIG. 6, at a point 61, the internal loss is 0.02 at a frequency of 170 Hz. At a point 62, the internal loss is 0.025 at a frequency of 1000 Hz. At a point 63, the internal loss is 0.03 at a frequency of 3000 Hz. At a point 64, the internal loss is 0.035 at a frequency of 5600 Hz.

At a point 65, the internal loss is 0.04 at a frequency of 9500 Hz. At a point 66, the internal loss is 0.043 at a frequency of 15000 Hz. At a point 67, the internal loss is 0.043 at a frequency of 20000 Hz. At a point 68, the internal loss is 0.06 at a frequency of 26000 Hz.

The PET film achieves the internal loss desirable for the operation of the speaker diaphragm.

Figure 7:
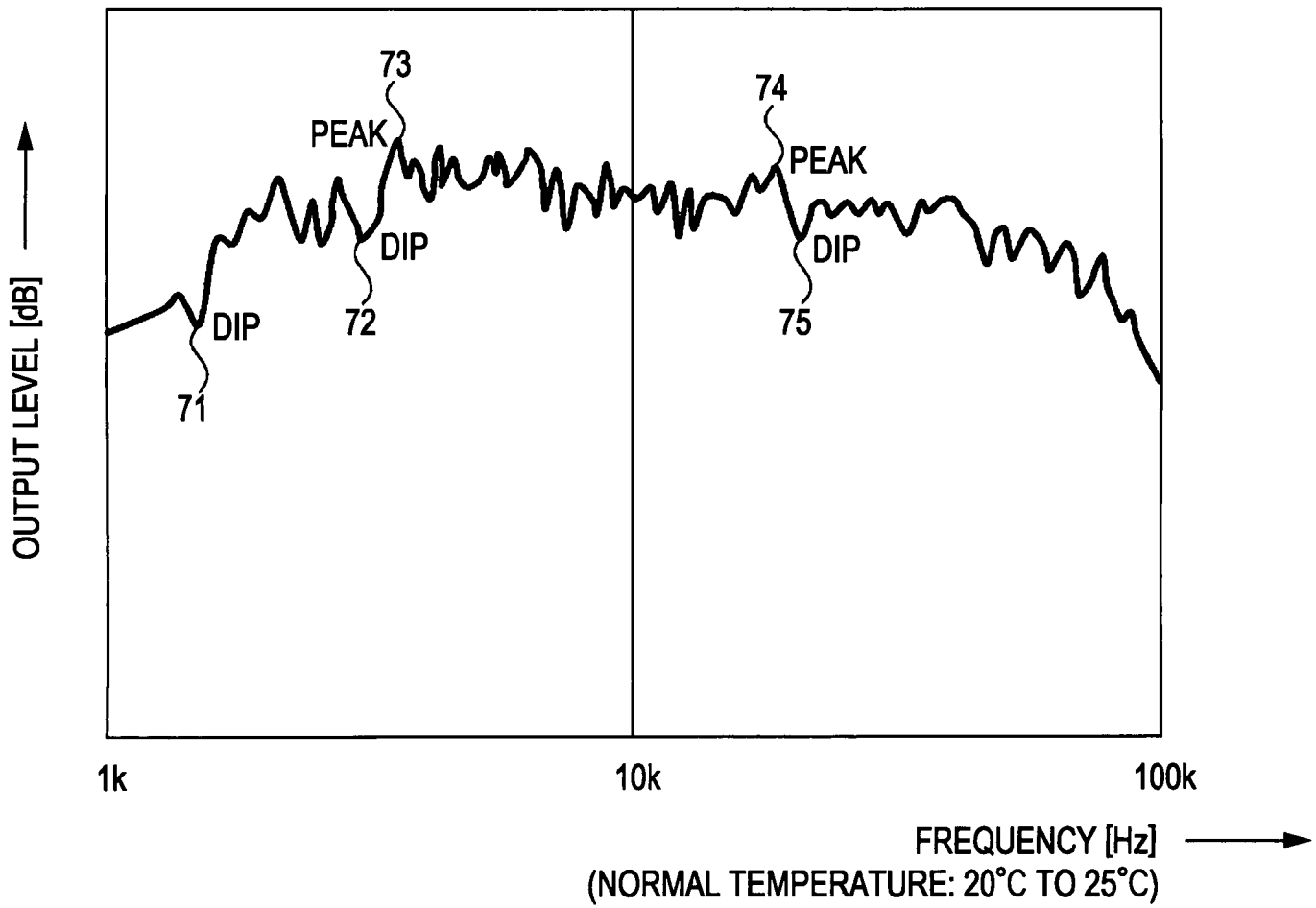
FIG. 7 is a graph showing a frequency characteristic of a speaker incorporating a speaker diaphragm made of the PET film.

FIG. 7 is a graph showing the frequency characteristic of the speaker including the speaker diaphragm made of the PET film. The frequency characteristic at normal temperature (20° C. to 25° C.) is shown in FIG. 7.

As shown in FIG. 7, a dip 71 appears at a frequency of 2 kHz. A dip 72 appears at a frequency of 5 kHz. A peak 73 appears at a frequency of 6 kHz. A peak 74 appears at a frequency of 25 kHz. A dip 75 appears at a frequency of 30 kHz.

The PET film does not achieve a smooth frequency characteristic desired for the operation of the speaker diaphragm.

Figure 8:
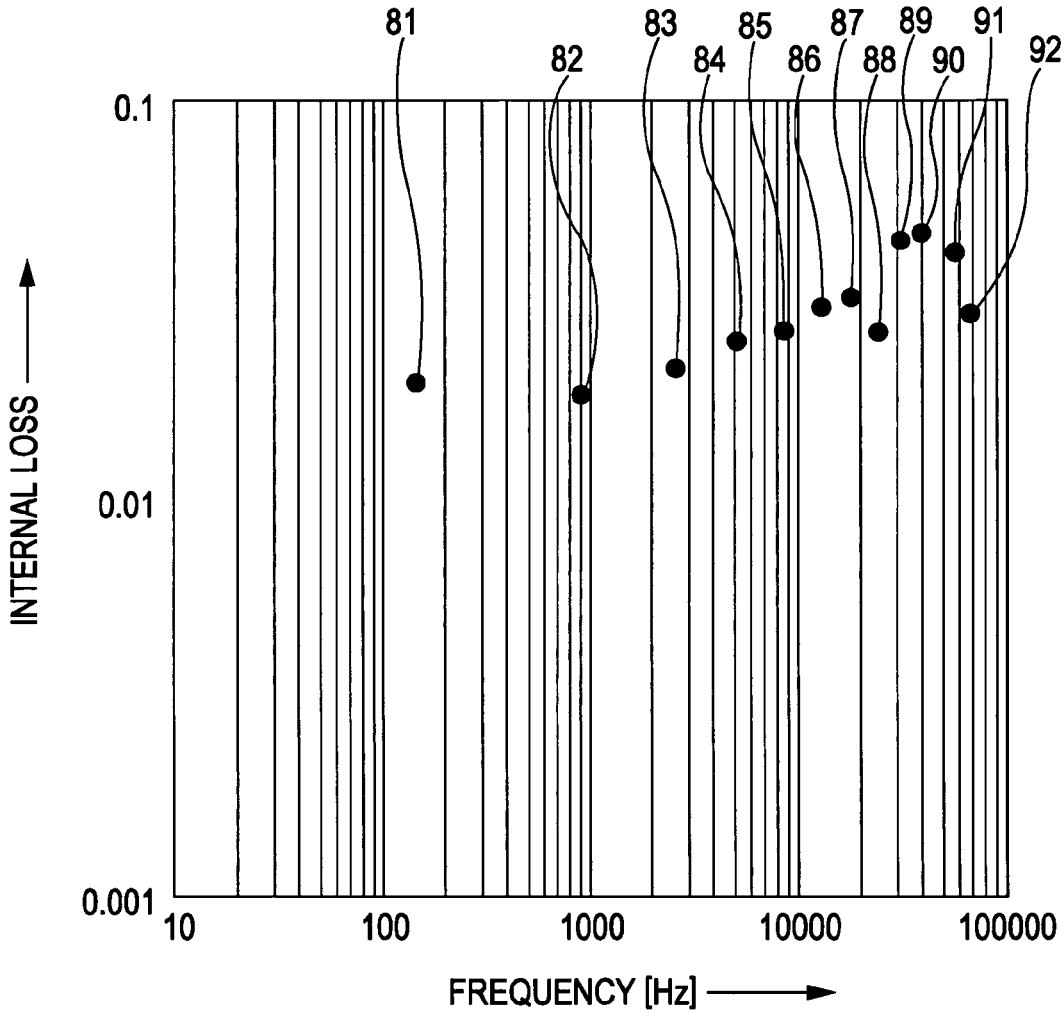
FIG. 8 is a graph showing the relationship between the internal loss of a PI-coated PET film and the frequency.

FIG. 8 is a graph showing the relationship between the internal loss and the frequency for the PI-coated PET film. The internal loss is indicated as a relative value also in FIG. 8.

In FIG. 8, at a point 81, the internal loss is 0.02 at a frequency of 170 Hz. The point 81 corresponds to the point 61 shown in FIG. 6 and indicates that a desired internal loss is obtained.

At a point 82, the internal loss is 0.019 at a frequency of 900 Hz. The point 82 corresponds to the point 62 in FIG. 6 and indicates that the desired internal loss is not obtained. However, the internal loss close to that at the point 62 is obtained.

At a point 83, the internal loss is 0.022 at a frequency of 2600 Hz. The point 83 corresponds to the point 63 in FIG. 6 and indicates that the desired internal loss is not obtained. However, the internal loss close to that at the point 63 is obtained.

At a point 84, the internal loss is 0.025 at a frequency of 5000 Hz. The point 84 corresponds to the point 64 in FIG. 6 and indicates that the desired internal loss is not obtained. However, the internal loss close to that at the point 64 is obtained.

At a point 85, the internal loss is 0.026 at a frequency of 9000 Hz. The point 85 corresponds to the point 65 shown in FIG. 6 and indicates that the desired internal loss is not obtained. However, the internal loss close to that at the point 65 is obtained.

At a point 86, the internal loss is 0.03 at a frequency of 14000 Hz. The point 86 corresponds to the point 66 shown in FIG. 6 and indicates that the desired internal loss is not obtained. However, the internal loss close to that at the point 66 is obtained.

At a point 87, the internal loss is 0.032 at a frequency of 18000 Hz. The point 87 corresponds to the point 67 in FIG. 6 and indicates that the desired internal loss is not obtained. However, the internal loss close to that at the point 67 is obtained.

At a point 88, the internal loss is 0.026 at a frequency of 25000 Hz. The point 88 corresponds to the point 68 in FIG. 6 and indicates that the desired internal loss is not obtained.

At a point 89, the internal loss is 0.046 at a frequency of 30000 Hz. At a point 90, the internal loss is 0.048 at a frequency of 38000 Hz. At a point 91, the internal loss is 0.042 at a frequency of 56000 Hz. At a point 92, the internal loss is 0.03 at a frequency of 66000 Hz.

The PI-coated PET film achieves an internal loss desirable for the operation of the speaker diaphragm in the high frequency range.

Figure 9:
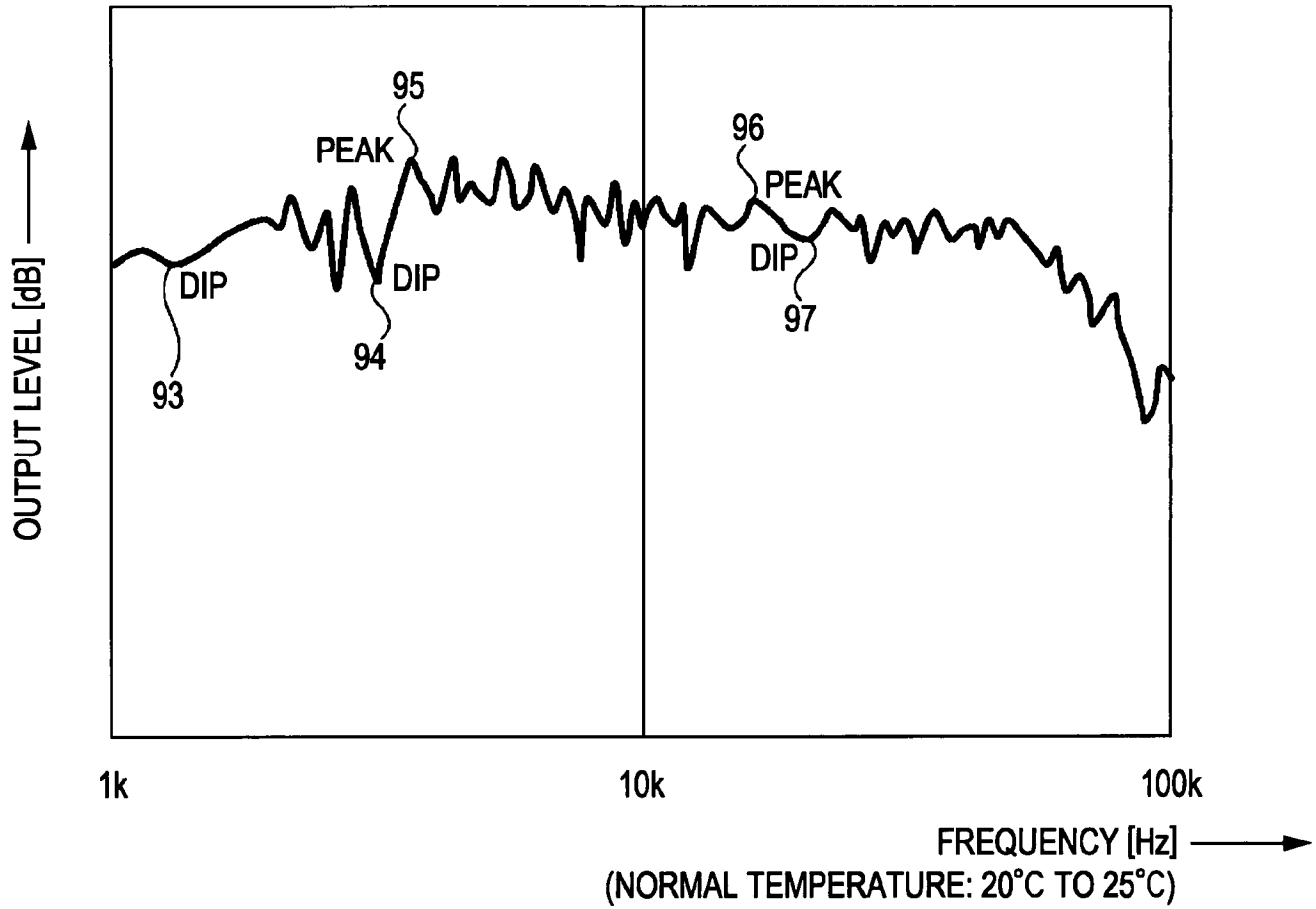
FIG. 9 shows a frequency characteristic of a speaker incorporating a speaker diaphragm made of the PI-coated PET film.

FIG. 9 is a graph showing the frequency characteristic of a speaker including the speaker diaphragm made of the PI-coated PET film and shows the characteristic at normal temperature (20° C. to 25° C.).

In FIG. 9, the dip 93 at a frequency of 2 kHz is less sharp. The dip 93 corresponds to the dip 71 in FIG. 7.

The dip 94 at 5 kHz is lowered. The dip 94 corresponds to the dip 72 in FIG. 7.

The peak 95 appears at a frequency of 6 kHz. The peak 95 corresponds to the peak 73 in FIG. 7.

The peak 96 at a frequency of 25 kHz is smoothed. The peak 96 corresponds to the peak 74 in FIG. 7.

The dip 97 at a frequency of 30 kHz is smoothed. The dip 97 corresponds to the dip 75 in FIG. 7.

The PI-coated PET film achieves a smooth frequency characteristic desirable for the operation of the speaker diaphragm.

As described above, the internal loss of the PI-coated PET film shown in FIG. 8 is slightly lower than that of the PET film shown in FIG. 6. However, it can be understood from the drawings that the values of internal loss in the PI-coated PET film are close to the internal loss of the PET film.

To investigate the effects of these two films during actual sound output, speakers including the films were assembled and frequency characteristics shown in FIGS. 7 and 9 were taken.

As shown in FIG. 9, the peaks and dips in the frequency characteristic of the PI-coated PET film shown in FIG. 9 are moderated compared to the peaks and dips of the PET film shown in FIG. 7. Thus, it can be understood from the graph that the PI-coated PET film exhibits a frequency characteristic smoother than that of the PET film.

The speaker diaphragm used in the above-described experiments is a balance dome diaphragm having an outer diameter of 25 mm and a thickness of 0.05 mm as shown in FIG. 1. The diaphragm was formed into the shape shown in FIG. 1 by press-forming. A polyimide bobbin having a diameter of 13 mm was used as the voice coil, and a voice coil wire having a diameter of 0.07 mm was used. The number of turns of the wire was adjusted so that the impedance was 6 Ω.

A PI-coated PET film having both surfaces coated with polyimide was used as the film for the diaphragm.

The speaker diaphragm produced by press-forming the PI-coated PET film was used to conduct frequency measurement. The results showed that that peaks and dips of the speaker diaphragm made from the PI-coated PET film had values and widths smaller than those of the comparative example, i.e., a speaker diaphragm made of a PET single film. The number of the peaks and dips observed was also smaller. This shows that the present embodiment has advantageous effects.

Figure 10:
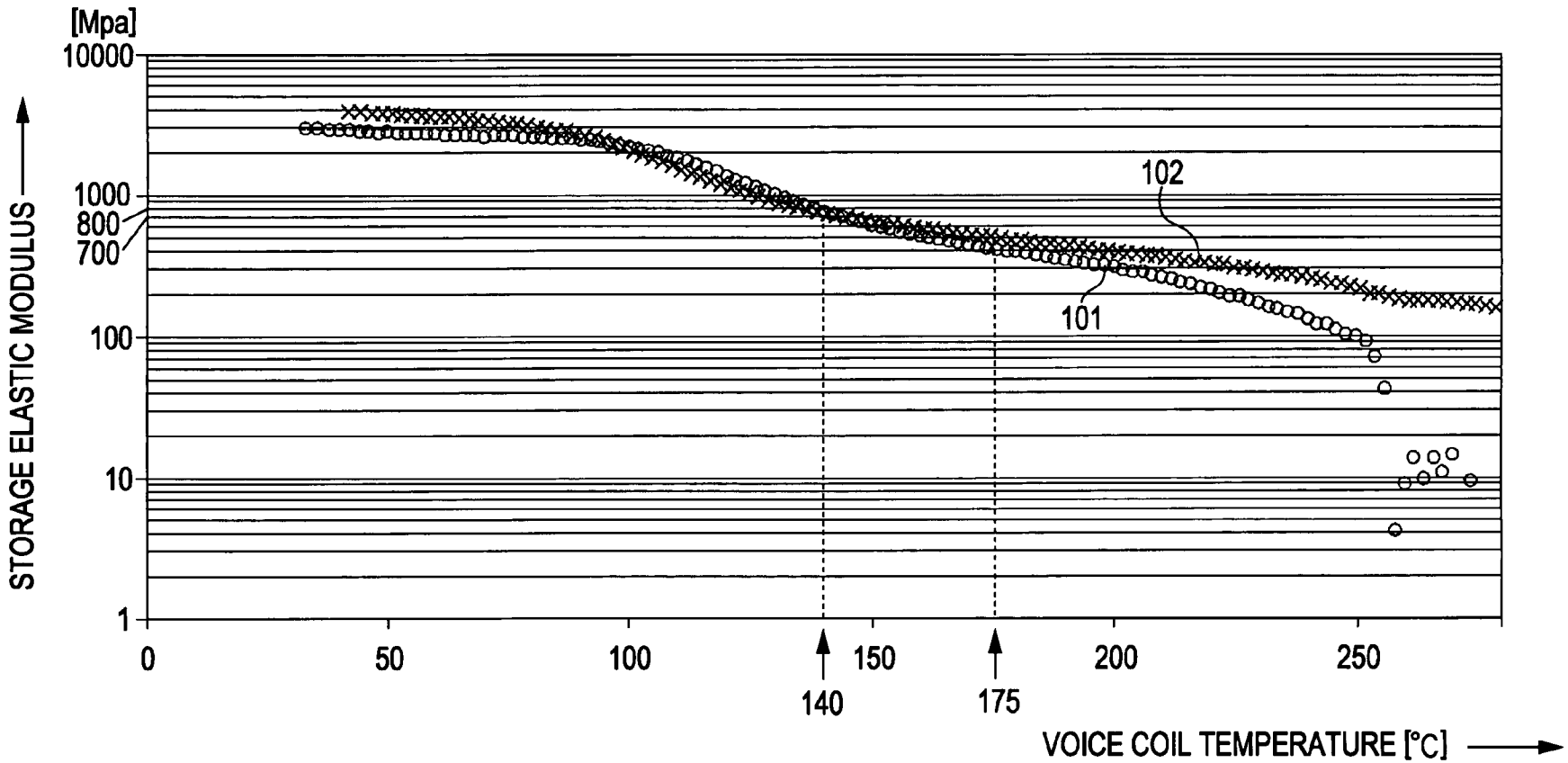
FIG. 10 is a graph showing the relationship between the elastic modulus of the speaker diaphragm made of the PET film and the voice coil temperature and between the elastic modulus of the speaker diaphragm made of the PI-coated PET film and the voice coil temperature.

FIG. 10 is a graph showing the relationship between the storage elastic modulus (real part of the complex elastic modulus) of the speaker diaphragm composed of a PET film and the voice coil temperature and the relationship between the storage elastic modulus of the speaker diaphragm composed of the PI-coated PET film and the voice coil temperature.

The graph in FIG. 10 was prepared by measuring the dynamic viscoelasticity of the speaker diaphragm made of the PET film and the speaker diaphragm made of the PI-coated PET film and then plotting the storage elastic modulus versus temperature on the basis of the observed complex elastic moduli. In other words, the degree of elastic response transmitted to one end of the speaker diaphragm when particular vibration is applied from the other end was measured while varying the temperature.

In FIG. 10, the temperature range of up to 140° C. is the usual operation range. A particular degree of storage elastic modulus is desired in this range. For example, a storage elastic modulus of about 700 to about 800 MPa is desired in this range. Since the temperature may be elevated beyond this range, the storage elastic modulus of this level is desirably maintained in a temperature range of from 140° C. to 175° C.

When a speaker diaphragm made from a PET film 101 is used, a storage elastic modulus of about 700 to about 800 MPa is obtained in the temperature range up to 140° C. However, in the temperature range of from 150° C. to 175° C., a storage elastic modulus of only about 600 to about 450 MPa is obtained.

When a speaker diaphragm made from a PI-coated PET film 102 is used, a storage elastic modulus of about 700 to about 800 MPa is obtained in the temperature range of 100° C. to 140° C. although this level is lower than that of the PET film 101. In the temperature range of 150° C. to 175° C., the PI-coated PET film 102 achieves a storage elastic modulus of about 700 to about 650 MPa. This is higher than the storage elastic modulus of the PET film 101.

This shows that the PI-coated PET film 102 is softer than the PET film 101 in the temperature of from 100° C. to 140° C. but undergoes a less decrease in elastic modulus than the PET film 101 beyond 150° C. This shows that the polyimide coatings provide improved heat resistance.

The speaker diaphragms made from the PI-coated PET film 102 and the PET film 101 were subjected to endurance test. The testing conditions were as follows: input: 130 W (on a 6Ω basis), time: 100 h, signal: DIN 2 noise (random noise signal).

The maximum voice coil temperature under the testing condition is 140° C. Although the speaker diaphragm made of the PI-coated PET film 102 retained its original shape after completion of the test without any problem, the speaker diaphragm made of the comparative PET film 101 did not retain its original shape and deformed into a flat shape. These results and the results of the dynamic viscoelasticity show that the effect of enhancing the maximum power input has become notable by the improved heat resistance.

Another embodiment will now be described.

Figures 11, 12:
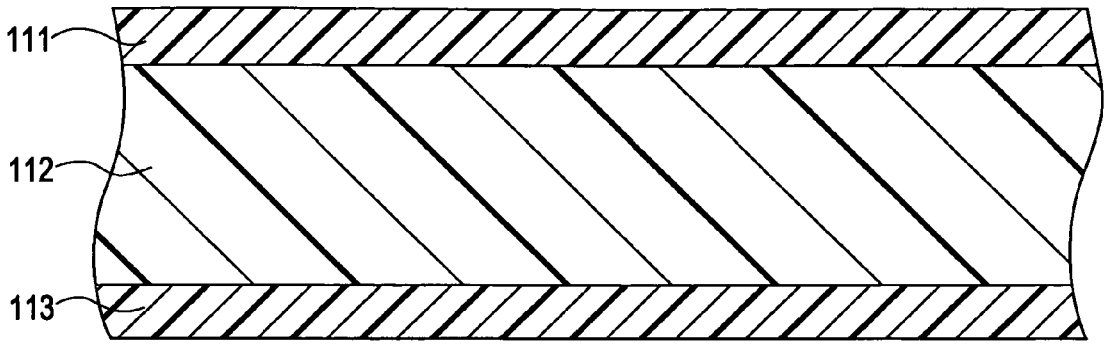
FIG. 11 is a cross-sectional view of a speaker diaphragm according to another embodiment.
FIG. 12 is a table showing the optimum thickness of a cone, i.e., the speaker diaphragm of the embodiment.

FIG. 11 is an enlarged partial cross-sectional view of another speaker diaphragm having the same configuration as the speaker diaphragm shown in FIG. 1.

In FIG. 11, the resin constituting the speaker diaphragm composed of a thermoplastic polymer material has a three-layer structure. In particular, a polyester film, i.e., a polybutylene terephthalate (PBT) layer 112, is used as the base material of the three-layer structure.

A polyetherimide (PEI) layer 111 and a polyetherimide (PEI) layer 113 are respectively disposed as the top layer and the bottom layer of the three-layer structure. In other words, both sides of the polybutylene terephthalate (PBT) layer 112 are provided with thin-film coatings, i.e., the polyetherimide (PEI) layers 111 and 113, respectively.

The polyester film, i.e., the polybutylene terephthalate (PBT) layer 112, is used as the base material because the formability of polybutylene terephthalate (PBT) during production process is excellent. The polyetherimide (PEI) layers 111 and 113 are used as the coating films in the top layer and the bottom layer because the heat resistance of polyetherimide (PEI) during temperature elevation is excellent.

A material including polybutylene terephthalate (PBT) layer 112 and the polyetherimide (PEI) layers 111 and 113 coating the polybutylene terephthalate (PBT) layer 112 was used for the speaker diaphragm. Thus, the internal loss can be made close to the internal loss of the polybutylene terephthalate while improving the heat resistance. Moreover, the frequency characteristic can be made smooth.

FIG. 12 is a table showing the optimum thickness of a cone, i.e., the speaker diaphragm of this embodiment.

FIG. 12 shows experimentally identified values of optimum thicknesses of a polybutylene terephthalate (PBT) layer as the base material and polyetherimide (PEI) layers as the top layer and the bottom layer of the three-layer structure.

The optimum total thickness of the cone having the three-layer structure was 50 μm. The optimum thickness of the polybutylene terephthalate (PBT) layer serving as the base material of the three-layer structure was 38 μm. The optimum thickness of each of the top and bottom polyetherimide (PEI) layers of the three-layer structure was 6 μm.

The same operation characteristics as the previously described embodiment can be obtained with the speaker diaphragm shown in FIGS. 11 and 12.

It should be understood that the above-described embodiments are merely nonlimiting examples and various modifications and alternations are possible without departing the scope of the appended claims or equivalents thereof.

What is claimed is:

1. A speaker diaphragm comprising:

a thermoplastic resin having a three-layer structure including:

a polyester film as a base material of the three-layer structure;

a polyimide-based resin layer approximately 6 microns thick as a top layer of the three-layer structure; and another polyimide-based resin layer approximately 6 microns thick as a bottom layer of the three-layer structure, wherein thicknesses of the top and bottom layers are each less than a thickness of the base material and wherein the thicknesses of the layers are selected such that the speaker diaphragm retains its shape when subjected to a temperature of 140 Celsius for a period of time of about one hundred hours.

2. The speaker diaphragm according to claim 1, wherein thicknesses of the base material, the top layer, and the bottom layer of the three-layer structure sum to a total thickness of about 50 microns.

3. The speaker diaphragm according to claim 2, wherein the thicknesses of the base material, the top layer, and the bottom layer of the three-layer structure are set so that a production process during forming of the speaker diaphragm is the same as another production process of another speaker diaphragm constituted from a single polyester film of a same total thickness.

4. The speaker diaphragm according to claim 2, wherein the thicknesses of the base material, the top layer, and the bottom layer of the three-layer structure are set so that the forming temperature during forming of the speaker diaphragm is the same as a forming temperature of another speaker diaphragm constituted from a single polyester film of a same total thickness.

5. The speaker diaphragm according to claim 1, wherein thicknesses of the base material, the top layer, and the bottom layer of the three-layer structure are set according to a selected internal loss characteristic or a frequency characteristic during operation of the speaker diaphragm.

6. The speaker diaphragm according to claim 5, wherein the thicknesses of the base material, the top layer, and the bottom layer of the three-layer structure are set so that the internal loss characteristic of the speaker diaphragm during operation is close to another internal loss characteristic being of another speaker diaphragm constituted from a single polyester film of a same total thickness.

7. The speaker diaphragm according to claim 5, wherein the thicknesses of the base material, the top layer, and the bottom layer of the three-layer structure are set so that the frequency characteristic of the speaker diaphragm during operation includes peaks and dips smaller than peaks and dips at corresponding frequencies in another frequency characteristic of another speaker diaphragm constituted from a single polyester film of a same total thickness.

8. The speaker diaphragm according to claim 1, wherein thicknesses of the base material, the top layer, and the bottom layer of the three-layer structure are set according to a selected elastic modulus during temperature elevation of the speaker diaphragm.

9. The speaker diaphragm according to claim 8, wherein the thicknesses of the base material, the top layer, and the bottom layer of the three-layer structure are set so that the speaker diaphragm relatively maintains the elastic modulus during the temperature elevation even in a temperature range where another elastic modulus of another speaker diaphragm constituted from a single polyester film of a same total thickness decreases.

10. The speaker diaphragm according to claim 1, wherein the polyimide-based resin layers comprise polyimide or polyetherimide and the polyester film comprises polyethylene terephthalate or polybutylene terephthalate.

11. The speaker diaphragm according to claim 2, wherein the polyester film comprises polyethylene terephthalate or polybutylene terephthalate, and each of the polyimide-based layers as the top layer and the bottom layer of the three-layer structure comprises polyimide or polyetherimide.

12. The speaker diaphragm according to claim 1, wherein the thicknesses of the base material, the top layer, and the bottom layer are selected so that the speaker diaphragm exhibits a storage elastic modulus between about 500 MPa and about 700 MPa in a temperature range between about 150° C. to about 175° C.

13. A speaker comprising:

a speaker diaphragm having a three-layer structure comprising:

a polyester film as a base material of the three-layer structure;

a polyimide-based resin layer as a top layer of the three-layer structure;

another polyimide-based resin layer as a bottom layer of the three-layer structure; and a centrally domed portion surrounded by a domed edge portion, wherein thicknesses of the top and bottom layers are each less than a thickness of the base material, and wherein the thicknesses of the layers are selected such that the speaker diaphragm retains its shape when subjected to a temperature of 140 Celsius for a period of time of about one hundred hours;

a magnetic circuit comprising:

an annular plate located adjacent the domed edge portion; and a central pole extending through the annular plate; and a voice coil attached to the speaker diaphragm and located in a gap between the annular plate and central pole.

14. The speaker of claim 13, wherein the thicknesses of the top and bottom layers are each less than one-sixth of the thickness of the base material.

15. The speaker of claim 14, wherein a total thickness of the speaker diaphragm is about 50 microns.

16. The speaker of claim 13, wherein the thicknesses of the top layer, resin layer, and bottom layer are selected to form a shape of the speaker diaphragm using a production process or forming temperature that is used for forming the shape in another speaker diaphragm consisting of a single polyester film having a thickness equivalent to a total thickness of the top layer, resin layer, and bottom layer.

17. The speaker of claim 16, wherein the production process includes press forming or pneumatic forming.

18. The speaker of claim 16, wherein the shape comprises a central domed portion surrounded by a domed edge portion.

* * * * *